US005801600A

United States Patent [19]

Butland et al.

[11] Patent Number: 5,801,600

[45] Date of Patent: Sep. 1, 1998

[54] VARIABLE DIFFERENTIAL PHASE SHIFTER PROVIDING PHASE VARIATION OF TWO OUTPUT SIGNALS RELATIVE TO ONE INPUT SIGNAL

[75] Inventors: Roger John Butland; William Emil Heinz, both of Wellington, New Zealand

[73] Assignee: Deltec New Zealand Limited, Wellington, New Zealand

[21] Appl. No.: 628,646

[22] PCT Filed: Oct. 14, 1994

[86] PCT No.: PCT/NZ94/00107

§ 371 Date: May 23, 1996

§ 102(e) Date: May 23, 1996

[87] PCT Pub. No.: WO95/10862

PCT Pub. Date: Apr. 20, 1995

[30] Foreign Application Priority Data

Oct. 14, 1993 [NZ] New Zealand ..... 248947

[51] Int. Cl.[6] ..... H01P 1/18; H01P 5/04

[52] U.S. Cl. ..... 333/127; 333/160; 333/245; 333/263; 333/24 C

[58] Field of Search ..... 333/127, 160, 333/245, 263, 24 C

[56] References Cited

U.S. PATENT DOCUMENTS

| | | | |
|---|---|---|---|
| 4,446,463 | 5/1984 | Irzinski | 343/371 |
| 4,570,134 | 2/1986 | Woodward | 333/127 |
| 4,602,227 | 7/1986 | Clark et al. | 333/109 |
| 4,616,195 | 10/1986 | Ward et al. | 333/160 |
| 4,635,062 | 1/1987 | Bierig et al. | 342/372 |
| 4,755,778 | 7/1988 | Chapell | 333/159 |
| 4,843,355 | 6/1989 | Knorr | 333/160 |
| 4,849,763 | 7/1989 | DuFort | 342/372 |

FOREIGN PATENT DOCUMENTS

| | | |
|---|---|---|
| 0 106 438 | 4/1984 | European Pat. Off. . |
| 0 357 085 | 3/1990 | European Pat. Off. . |
| 0 310 661 B1 | 6/1994 | European Pat. Off. . |
| 2737714 | 3/1979 | Germany . |
| 3902739 | 8/1990 | Germany . |
| 59-90401 | 5/1984 | Japan . |
| 4-144518/18 | 2/1992 | Japan . |
| 4-2014705/25 | 5/1992 | Japan . |
| 93-125240/15 | 5/1992 | Russian Federation . |
| 2 115 984 | 8/1983 | United Kingdom . |
| 2 158 996 | 4/1985 | United Kingdom . |
| 2 158 997 | 4/1985 | United Kingdom . |
| 2 159 333 | 4/1985 | United Kingdom . |
| 2 165 397 | 4/1985 | United Kingdom . |

*Primary Examiner*—Robert Pascal
*Assistant Examiner*—Babara Summons
*Attorney, Agent, or Firm*—Merchant, Gould, Smith, Edell, Welter & Schmidt, P.A.

[57] ABSTRACT

A variable differential phase shifter is provided. The device provides a continuous variation in phase between two outputs derived from a single input. The device is suitable for application at signal frequencies around 900 MHz, and is constructed in the form of an inner (38) and outer (37) sleeve capacitively coupled to an inner conductive rod (24) and outer conductive tube (26) respectively, wherein the inner (38), and outer (37) sleeves are connected to an input and can be moved in fixed relative relation thereby varying the phase relationship between the two outputs which are connected to the inner rod (24) and outer tube (26). A dielectric layer (25 and 27) may be provided around the inner rod (24) and outer tube (26). An unequal power division version of the device is provided for by the inclusion of a dielectric tube surrounding a portion of the inner rod.

20 Claims, 5 Drawing Sheets

VARIABLE DIFFERENTIAL PHASE SHIFTER PROVIDING PHASE VARIATION OF TWO OUTPUT SIGNALS RELATIVE TO ONE INPUT SIGNAL

This application claims benefit of international application PCT/NZ94/00107 filed Oct. 14, 1994.

THE TECHNICAL FIELD

The present invention relates to a variable differential phase shifter. The variable differential phase shifter of the invention allows the phase of two output signals to be continuously varied over a given range with respect to an input signal. The variable differential phase shifter of the invention is particularly suitable for use in tilting the beam of an antenna array.

BACKGROUND OF THE INVENTION

Referring to FIG. 1 a prior art antenna array consisting of four elements 1–4 is shown. Feed-line 5 supplies a signal to drive the antenna elements 1–4. The signal from line 5 is equally divided between branches 6 and 7. Feed line 6 supplies the driving signal to antenna elements 1 and 2. The signal from branch 6 is further divided between branches 9 and 10. A phase shifter 11 is provided in branch 10 to shift the phase of the signal supplied to antenna element 2 by β with respect to the phase of the signal driving antenna element 1. In branch 7 phase shifter 8 introduces a phase shift of 2β with respect to the phase of the signal in branch 6. This phase shifted signal is divided between branches 12 and 13. Antenna element 3 thus receives a driving signal which is phase shifted by 2β. A further phase shift element 14 is provided in branch 13 so that the signal driving antenna element 4 is phase shifted by 3β.

Accordingly, the antenna elements 1, 2, 3, 4 are phase shifted by an amount 0, 1β, 2β, 3β respectively. In this way the beam of the antenna array can be tilted by a desired amount. Sometimes, to control side lobe levels and beam shape, other than progressive phase shift may be employed. Non-equal power division may also be employed.

In prior art systems phase shifters 8, 11 and 14 may be lengths of cable or active phase shifters. Commonly, active phase shifters using PIN diodes are employed which can be switched on or off to introduce phase shifts in a branch of the feed network. The phase shifters may include a number of PIN diodes to allow a number of delays of different magnitudes in be introduced into a feed path as required.

Such prior art phase shifters suffer from the disadvantage that they can usually only provide phase shifts between respective branches in a stepped manner and cannot usually provide continuous differential phase shifting between branches. Further, high power PIN diodes used in active systems are both expensive, particularly where a large number of antenna elements are employed and have higher losses than the present device. Active systems using PIN diodes also introduce non-linearities and intermodulation.

Other particular advantages of the present invention are as follows:

Because there are no sliding metal contacts, the phase shifter will require little maintenance. If a suitable dielectric is used (for example polytetrafluoroethylene) the sliding friction will be low. This in an advantage when designing mechanical drive mechanisms or selecting suitable electric motors. Because there are no sliding electrically conductive surfaces in contact, the phase shift variation speed can be maximised.

Also, for a required differential phase shift, the amount of mechanical movement is half that required by in-line phase shifters. This may result in a more compact structure. Finally, incorporating a matching section in the phase shifter structure reduces the manufacturing cost of a typical feed network.

DISCLOSURE OF THE INVENTION

It is an object of the present invention to provide a variable differential phase shifter which overcomes the above disadvantages or at least provides the public with a useful choice.

According to one aspect of the invention there is provided a variable differential phase shifter comprising:

a coaxial line comprising an inner conductive rod and an outer conductive tube coupled at ends thereof to first and second outputs;

an inner sleeve capacitively coupled to the inner conductive rod and slideable therealong; and an outer sleeve capacitively coupled to the outer conductive tube and slideable therealong; the inner and outer sleeves being connected to an input and being slideable along said coaxial line in fixed relative relationship to vary the phase relationship of the signals output at the first and second outputs with respect to a signal supplied to the input.

Preferably a dielectric layer is provided between the inner conductive rod and inner sleeve and a further dielectric layer is provided between the outer conductive tube and the outer sleeve. The outputs are preferably transition cones which enable the phase shifter to be coupled directly to coaxial cables.

The input preferably comprises a rod perpendicular to the inner sleeve which slides within a slot in the outer conductive tube, the rod being coaxial with a tube perpendicular to the outer sleeve and held in fixed relation thereto by an intermediate dielectric, the ends of the rod and tube away from the sleeves being connected to a transition cone.

There is also provided an unequal power variable phase shifter having a dielectric tube provided around a length of the inner conductive rod adpated so that the power output at the first and second outputs is unequal.

BRIEF DESCRIPTION OF THE DRAWINGS

The invention will now be described by way of example with reference to the accompanying drawings in which:

Referring to FIG. 2 an equal power dividing variable differential phase shifter according to one aspect of the invention in shown. All elements shown are circular in cross-section. In alternate embodiments other cross-sections may he used, such as square, rectangular or hexagonal cross sections.

Figure 1:
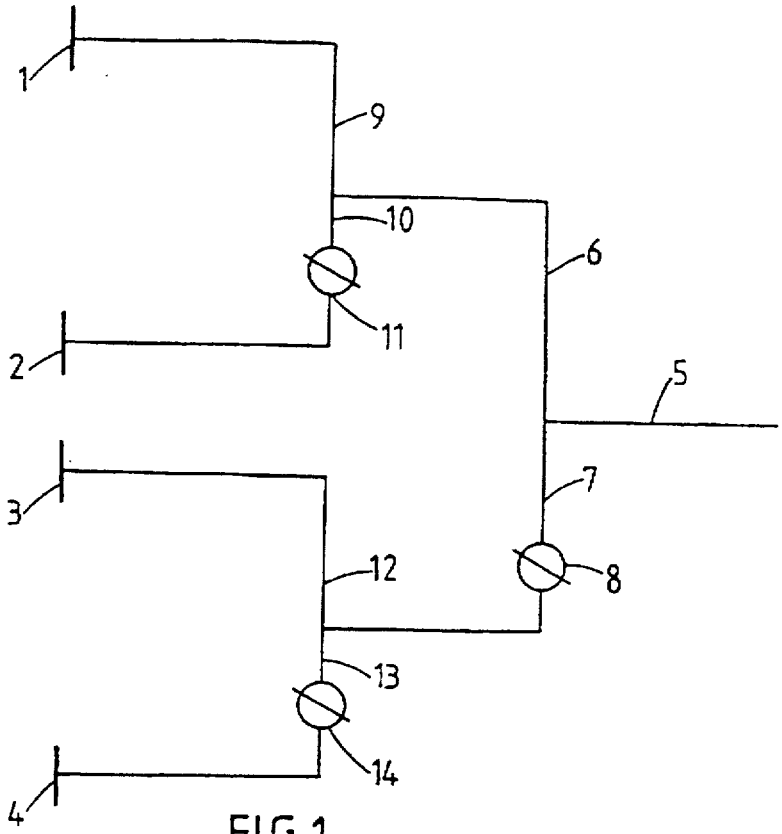
FIG.1 PRIOR ART
FIG. 1: shows schematically the feed network of a prior art antenna array.

A coaxial cable 21 supplies a signal to the phase shifter and the outputs of the phase shifter are output via coaxial cables 22 and 23. Central conductor 21*a* of coaxial cable 21 is electrically connected to feed rod 32 via conical section 34. Feed rod 32 is electrically connected to inner sleeve 38 which may slide along inner conductive rod 24. Inner conductive rod 24 is preferably provided with a thin dielectric coating 25 along its length so that inner conductive rod 24 and inner sleeve 38 art capacitively coupled. The ends of inner conductive rod 24 are coupled to inner conductors 22*a* and 23*a* via conical sections 30 and 28, respectively.

The outer conductor 21*b* of coaxial cable 21 is electrically connected to feed tube 33 via conical portion 35. Feed tube 33 is electrically connected to outer sleeve 37 which can slide along outer conductive tube 26. Outer conductive tube 26 is provided with a thin dielectric layer 27 along its length upon which outer sleeve 37 slides. The ends of outer conductor 26 are coupled to the outer conductors 22*b* and 23*b* via conical sections 31 and 29 respectively. Conical sections 28, 29, 30, 31, 34 and 35 assist to minimize the voltage standing wave ratio (VSWR) at the input 21.

The dielectric coatings 25 and 27 should be a radio frequency low loss material, and should preferably have a low coefficient of friction. A suitable material is polytetrafluorethylene.

Figure 3:
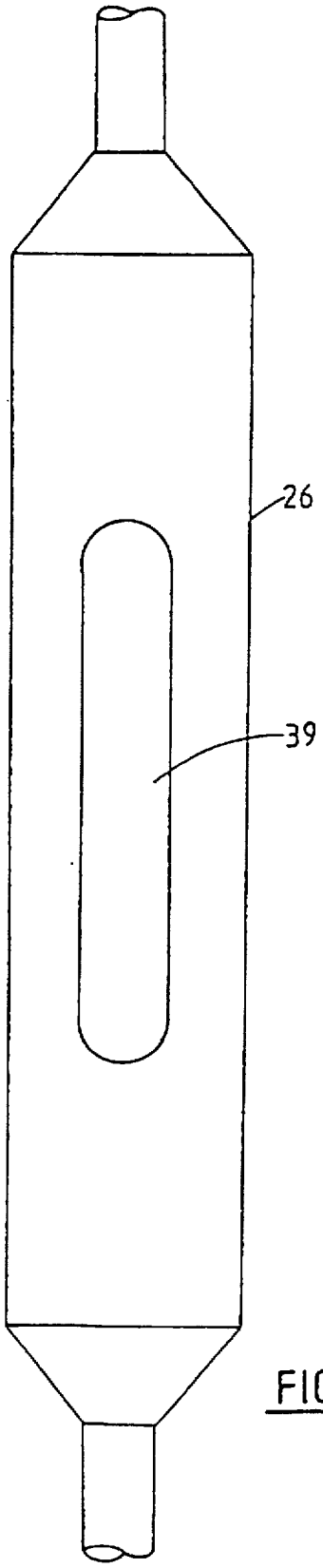
FIG. 3: shows of the outer conductive tube shown in FIG. 2 viewed in the direction of arrow A.

Feed rod 32 is held in fixed relationship with feed tube 33 by dielectric block 36. Referring to FIG. 3 it will be seen that outer conductive tube 26 is provided with a slot 39 along its axis. Feed rod 32 can slide within slot 39 as the tee assembly (33, 37, 32, 38) slides to and fro along outer conductive tube 26. It will be appreciated that all components indicated, apart from dielectric materials 25, 27 and 36, will be formed of suitable conductive material, such as brass, copper etc.

The arrangement of inner conductive sleeve 38, dielectric layer 25 and inner conductive rod 24 forms a capacitive coupling. Likewise, the arrangement of outer sleeve 37, dielectric layer 27 and outer conductive tube 26 forms another capacitive coupling. At frequencies around 900 MHz or above the reactances of the capacitive coupling are so low that they constitute a direct coupling between sleeves 37 and 38 and outer conductive tube 26 and inner conductive rod 24 respectively.

A signal supplied to input cable 21 will divide between the two outputs (i.e. coaxial output cable 22 and 23) evenly. By sliding the tee section with respect to outer conductive tube 26 the phase of a signal supplied to output coaxial cable 22 and output coaxial cable 23 may be varied. For example, if the tee connection is shifted so that it is to the left of the centre of outer conductive tube 26 then the distance the signal must travel to reach output coaxial cable 22 is less than the distance the signal must travel to reach output coaxial cable 23, hence there is a phase delay of the signal output to coaxial cable 23 with respect to the phase of the signal output to coaxial cable 22. By sliding the tee section right or left along outer conductive tube 26 the desired phase difference between the outputs 22, 23 say be achieved. It will be appreciated that the phase shifter described allows continuous phase variation between the outputs 22, 23 within the a allowed range.

Figure 2:
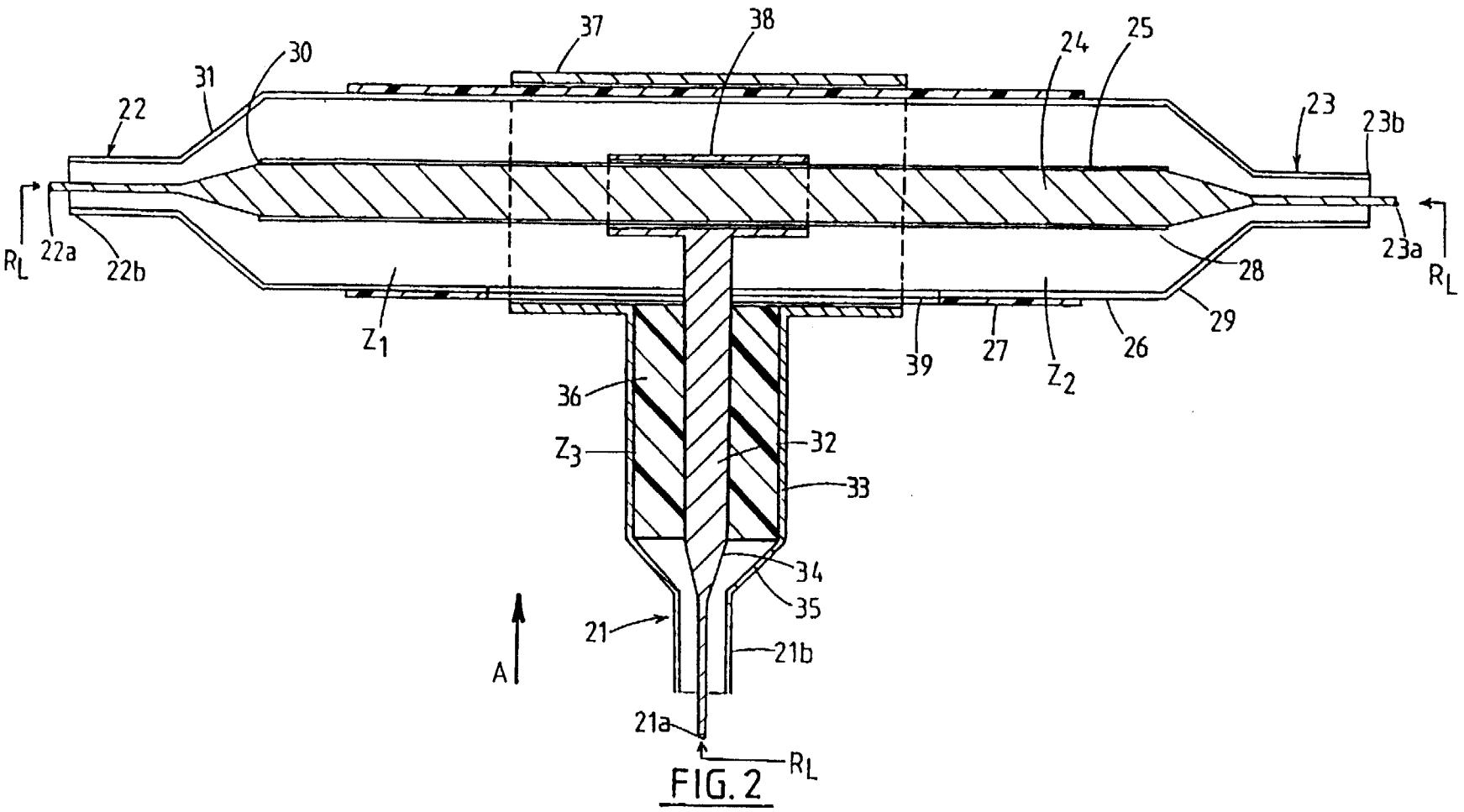
FIG. 2: shows a sectional view of a variable differential phase shifter according to one aspect of the invention.

For the equal power dividing variable differential phase shifter shown in FIG. 2, $Z_1$, $Z_2$, and $Z_3$ are the characteristic impedances of the sections shown and $R_L$ is the system impedance (in this case 50 ohms).

For equal power division:

$$Z_1=Z_2=R_L$$

$$Z_3=R_L/2$$

When properly terminated the tapping point impedance $Z_T$ is equivalent to two $R_L$ loads in parallel ($Z_T=R_L/2$).

Thus, a matching section is required between line 21 and the tapping point. It is formed by feed rod 32, feed tube 33 and dielectric material 36. Feed rod 32 is preferably a quarter wavelength long and inner conductive sleeve 38 is preferably between one sixteenth to an eighth of a wavelength long.

If, for example, the system impedance is 50 ohms then $$Z_1=Z_2=50 \text{ ohms}$$

$$Z_T=25 \text{ ohms}$$

and $$Z_3=35.4 \text{ ohms}$$

For an unequal power dividing variable differential phase shifter, $Z_1$ does not equal $Z_2$. One option is to let either to or $Z_1$ or $Z_2=R_L$ so that the other characteristic impedance is less than $R_L$, e.g:

$$Z_1=R_L$$

$$Z_2<Z_1$$

and $$l_2=/4$$

then $$Z_3=\frac{R_L Z_2}{\sqrt{Z_2^2+R_L^2}}$$

for matching transmission line $Z_1$ input impedance to $R_L$ (where $l_2$ is the electrical length of section $Z_2$).

Transformer $Z_3$ could be constructed from two sections, one of $Z_3'$ and the other $Z_3''$. Alternatively, it could be made with a tapered characteristic impedance. It will be recognized by a person skilled in the art that these alternatives will increase the operating bandwidth of the device.

Figure 6:
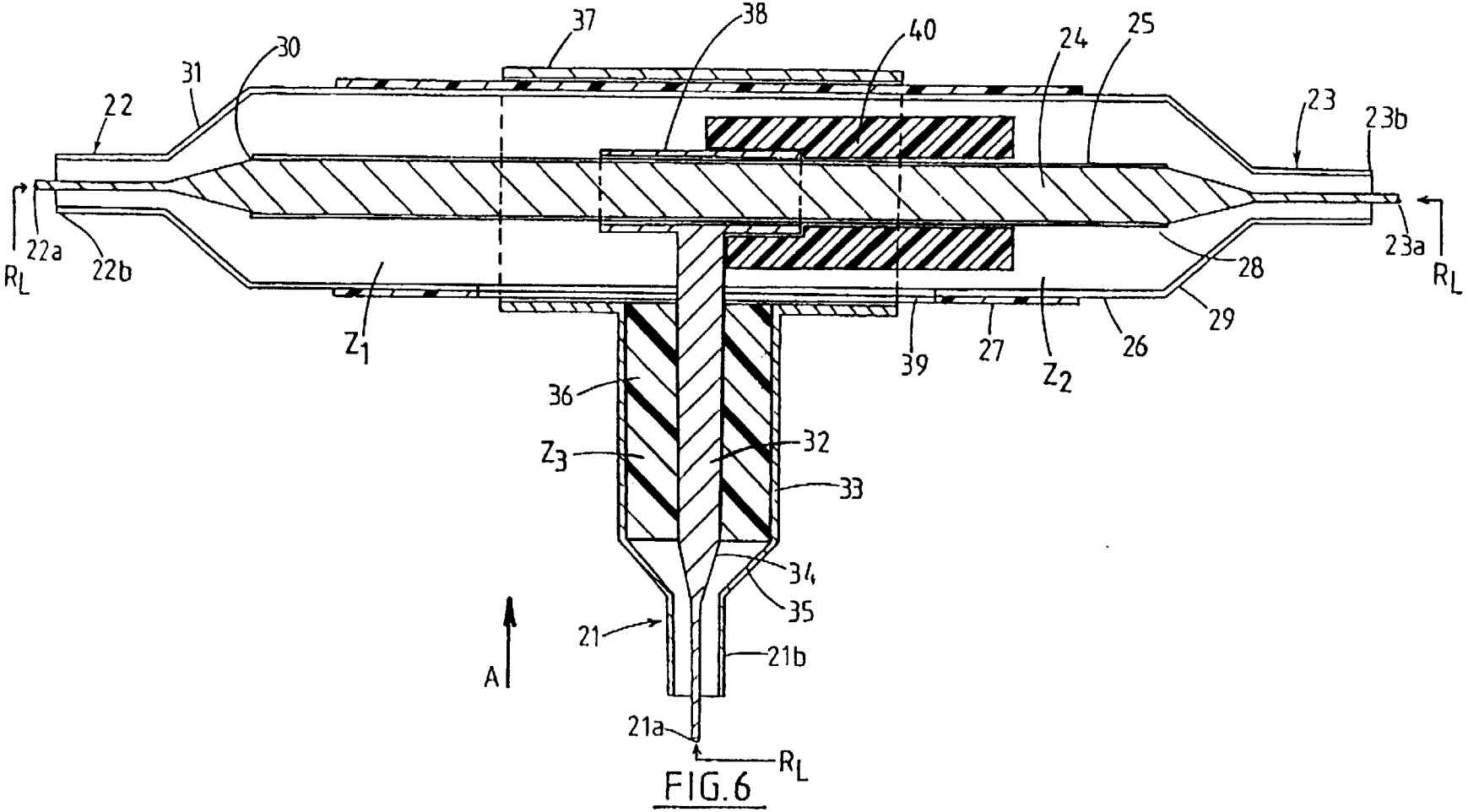
FIG. 6: shows the phase shifter of FIG. 2 incorporating a dielectric tube for unequal power division.

Referring now to FIG. 6, to adjust the impedance of section $Z_2$ to the desired value a dielectric tube 40 may be secured to inner sleeve 38 which is slideable relative to inner conductive rod 24. It will however be appreciated that other means may be used to alter the impedance of section $Z_2$.

It should also be appreciated that in other embodiments the phase shifter may be driven via coaxial cable 22 or 23. If the phase shifter is driven by coaxial cable 22 then the output at coaxial cable 23 stays in constant phase relationship with the input at coaxial cable 22. Only the output at coaxial cable 21 varies as the t-section slides to and fro. It will be appreciated that for such a configuration the characteristic impedances would have to be adjusted, using similar equations to those described above but with $Z_1$ and $Z_3$ interchanged. Dielectric tube 36 may be replaced by spacers at the ends thereof if less dielectric material is required.

Figure 4:
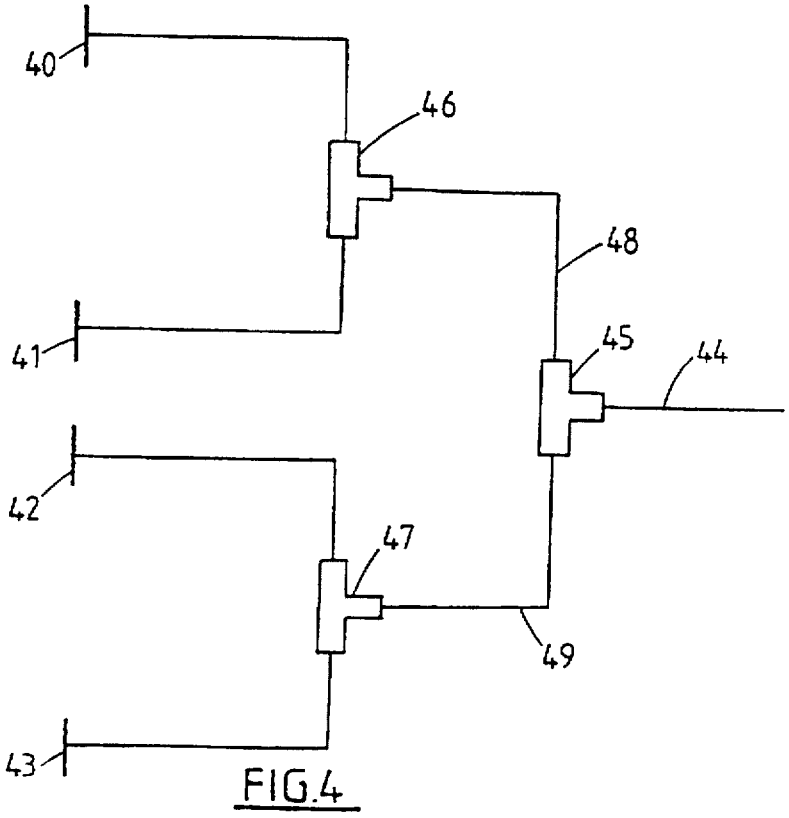
FIG. 4: shows an antenna array incorporating the phase shifters of the invention.

Referring now to FIG. 4 an antenna array incorporating the phase shifter of the invention is show. The antenna array consists of antenna elements 40 to 43. Phase shifters 45 to 47 are of the form shown in FIG. 2. A signal supplied from feed line 44 is divided by phase shifter 45 between branches 48 and 49. Phase shifter 46 divides the signal from feedline 48 between antenna elements 40 and 41. Phase shifter 47 divides the signal supplied on feedline 49 between antenna elements 42 and 43.

If the tee of phase shifters 46 and 47 is moved up a distance d from their central positions and the tee of phase shifter 45 is moved up a distance to 2*d* from its central position then phase shifts of 0, β, 2β, 3β will result for the antenna elements 40, 41, 42 and 43. It will thus be appreciated that the beam of the antenna may be tilted by any desired amount by shifting the phase shifters 46 and 47 a distance d from centre and phase shifter 45 a distance 2*d*.

In one embodiment a mechanical coupling may be provided so that the tees of phase shifters 46 and 47 are shifted in unison and the tee of phase shifter 45 is moved twice the distance of phase shifters 46 and 47. The tees of phase shifters 46 and 47 may be linked by a rigid member to ensure that they move in unison whilst the tee of phase shifter 45 may be linked to the member via a pivoted arm so that the tee of phase shifter 45 moves twice the distance of the tees of phase shifters 46 and 47.

Figure 5:
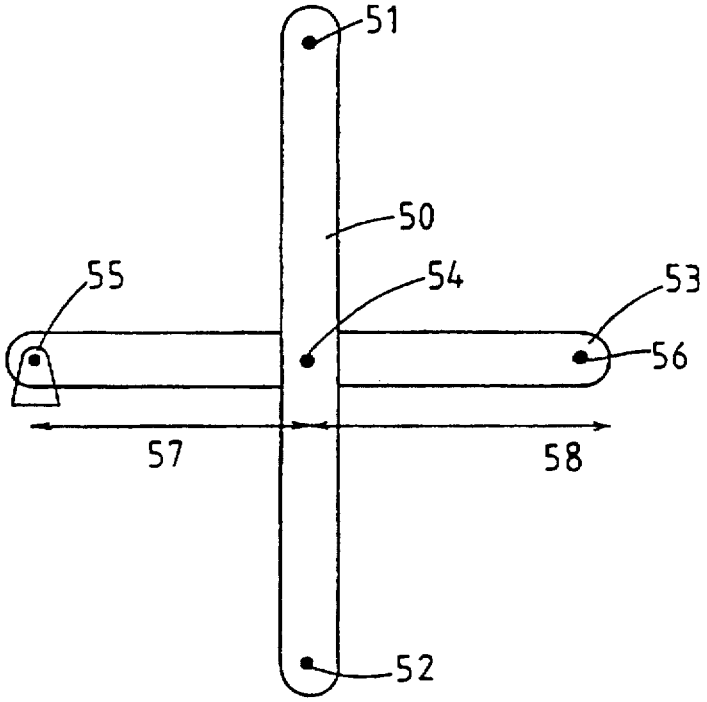
FIG. 5: shows a mechanism for adjusting the phase shifter shown in FIG. 2.

A possible mechanism is shown in FIG. 5. Points 51 and 52 of member 50 may be linked to the tees of phase shifters 46 and 47 to ensure that they move in unison. Member 53 may be pivotally connected to member 50 at point 54. One and 55 of member 53 may be connected to a pivot point mounted to an antenna housing. The other end 56 may be connected to the tee of phase shifter 45. The length 58 between pivot point 54 and point 56 may be the same as the length 57 between pivot point 54 and pivot point 55. In this way the tee of phase shifter 45 moves twice the distance moved by the tees of phase shifters 46 and 47.

It will be appreciated that there are many other possible mechanisms that may be used to adjust the tees in the required manner. Length 57 may be greater than or less than length 58 if other than progressive phase shifting is required. Non-linear linkages may be employed where other than progressive phase shifting is required. The linkages may be manually adjusted or driven by suitably geared motors, stepper motors or the like.

The present invention thus provides a relatively inexpensive continuously variable differential phase shifter suitable for use in high power phase shifting applications. The phase shifter of the present invention may find particular application in high power antenna arrays.

Where in the foregoing description reference has keen made to integers or components having known equivalents then such equivalents are herein incorporated as if individually set forth.

Although this invention has been described by way of example it is to be appreciated that improvements and/or modifications may be made without departing from the scope or spirit of the invention.

INDUSTRIAL APPLICABILITY

The variable differential phase shifter of the present invention may find application in the construction and operation of antenna arrays wherein beam tilting or squinting is required. Such arrays are commonly found in telecommunications applications such as cellular networks. The variable differential phase shifter may also be substituted for PIN diodes in situations where a device is required for varying the phase of two output signals.

We claim:

1. A variable differential phase shifter comprising:

a coaxial line comprising an inner conductive rod and an outer conductive tube coupled at ends thereof to first and second outputs;

an inner sleeve capacitively coupled to the inner conductive rod and slideable therealong; and an outer sleeve capacitively coupled to the outer conductive tube and slideable therealong; the inner and outer sleeves being connected to an input and being slideable along said coaxial line in fixed relationship relative to each other to vary the phase relationship of the signals output at the first and second outputs with respect to a signal supplied to the input.

2. A variable differential phase shifter as claimed in claim 1 wherein the outputs are adpated to be coupled directly to coaxial cables.

3. A variable differential phase shifter as claimed in claim 2 wherein the outputs have transition cones to connect to coaxial cables, having different diameters from the outputs, so as to obtain minimum VSWR.

4. A variable differential phase shifter as claimed in claim 3 wherein the input comprises a second coaxial line comprising:

a second inner conductive rod and a second outer conductive tube, wherein said second inner conductive rod is coaxial with the second outer conductive tube, and said second inner conductive rod and said second outer conductive tube are connected substantially perpendicularly to the inner and outer sleeves respectively, and wherein the second inner conductive rod slides within a slot in the outer conductive tube.

5. A variable differential phase shifter as claimed in claim 4 wherein the input is adapted to be coupled directly to coaxial cables.

6. A variable differential phase shifter as claimed in claim 5 wherein the second coaxial line has a transition cone at the end distant from the sleeves, to connect to coaxial cable having a different diameter from the input so as to obtain minimum VSWR.

7. A variable differential phase shifter as claimed in claim 4 wherein the second coaxial line has a transition cone at the end distant from the sleeves, to connect to coaxial cable having a different diameter from the input so as to obtain minimum VSWR.

8. A variable differential phase shifter as claimed in claim 7 wherein the second inner conductive rod is hold in fixed relation to the second outer conductive tube by an intermediate dielectric.

9. A variable differential phase shifter as claimed in claim 8 wherein a dielectric tube is provided around a length of the inner conductive rod adapted so that the power output at the first and second outputs is unequal.

10. A variable differential phase shifter as claimed in claim 9 wherein the cross sectional area of said second inner conductive rod varies along its length.

11. A variable differential phase shifter as claimed in claim 10 wherein the cross sectional area of said second outer conductive tube varies along its length.

12. A variable differential phase shifter as claimed in claim 11 wherein said second coaxial line in adapted to provide a tapering characteristic impedance.

13. A variable differential phase shifter as claimed in claim 4 wherein the second inner conductive rod is held in fixed relation to the second outer conductive tube by an intermediate dielectric.

14. A variable differential phase shifter as claimed in claim 4 wherein the cross sectional area of said second inner conductive rod varies along its length.

15. A variable differential phase shifter as claimed in claim 14 wherein the cross sectional area of said second outer conductive tube varies along its length.

16. A variable differential phase shifter as claimed in claim 1 wherein a dielectric layer is provided between the inner conductive rod and the inner sleeve.

17. A variable differential phase shifter as claimed in claim 16 wherein the outputs are adapted to be coupled directly to coaxial cables.

18. A variable differential phase shifter as claimed in claim 16 wherein a dielectric tube is provided around a length of the inner conductive rod adapted so that the power output at the first and second outputs is unequal.

19. A variable differential phase shifter as claimed in claim 16 wherein the input comprises a second coaxial line comprising:

a second inner conductive rod and a second outer conductive tube, wherein said second inner conductive rod is coaxial with the second outer conductive tube, and said second inner conductive rod and said second outer conductive tube are connected substantially perpendicularly to the inner and outer sleeves respectively, and wherein the second inner conductive rod slides within a slot in the outer conductive tube.

20. A variable differential phase shifter as claimed in claim 16, wherein a dielectric layer is provided between the outer conductive tube and the outer sleeve.

* * * * *